US008205368B2

(12) United States Patent
Banman

(10) Patent No.: US 8,205,368 B2
(45) Date of Patent: Jun. 26, 2012

(54) SPINNER TROPHY

(75) Inventor: John Banman, S. El Monte, CA (US)

(73) Assignee: Plastic Dress-Up Co., South El Monte, CA (US)

( * ) Notice: Subject to any disclaimer, the term of this patent is extended or adjusted under 35 U.S.C. 154(b) by 131 days.

(21) Appl. No.: 12/653,479

(22) Filed: Dec. 14, 2009

(65) Prior Publication Data

US 2011/0138662 A1 Jun. 16, 2011

(51) Int. Cl.
*G09F 11/02* (2006.01)

(52) U.S. Cl. ..... 40/493; 446/236

(58) Field of Classification Search ..... 40/493; 248/127, 131, 158, 176.1, 346.06, 349.1, 248/458, 521; 446/83, 228, 236, 330, 331, 446/359

See application file for complete search history.

(56) References Cited

U.S. PATENT DOCUMENTS

| | | | | |
|---|---|---|---|---|
| 2,806,938 | A * | 9/1957 | Henry | 40/431 |
| 3,923,280 | A * | 12/1975 | Good | 248/405 |
| 5,749,557 | A * | 5/1998 | Chang | 248/405 |
| 2003/0159320 | A1 * | 8/2003 | Lanci | 40/493 |
| 2005/0233674 | A1 * | 10/2005 | Torres | 446/236 |

* cited by examiner

*Primary Examiner* — Joanne Silbermann
(74) *Attorney, Agent, or Firm* — James E. Brunton

(57) ABSTRACT

A novel spinner trophy that includes a supporting base and a decorative member connected to the supporting base for rotation with respect thereto.

6 Claims, 5 Drawing Sheets

SPINNER TROPHY

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to achievement awards. More particularly, the invention concerns a novel spinner trophy that includes a supporting base and a decorative member connected to the supporting base for rotation with respect thereto.

2. Description of Related Art Including Information Disclosed Under 37 CFR 1.97 and 1.98

Achievement awards of various types are frequently given to individuals and athletic teams for outstanding achievements in sports such as golf, bowling, tennis, baseball, basketball and the like. These awards include medals, plaques and a number of different types of small statues of which frequently take the form of a decorative member of an appropriate design that is mounted on a supporting base. Exemplary of one type of achievement award is that described in U.S. Pat. No. 6,828,034 issued to the present inventor. This latter patent discloses an award construction that includes a decorative member, a supporting base for supporting the decorative member and an alternate means for interconnecting the decorative member with the supporting base. More particularly, in one form of the invention, the base portion of the decorative member includes a peripheral portion having a locking rim that can be lockably interconnected with a yieldably deformable locking assembly that is affixed to and extends upwardly from the upper surface of the supporting base. In another form of the invention, the identical base portion of the decorative member can be interconnected with the support base by means of a threaded rod which is threadably received within a threaded bore formed in the base portion of the decorative member.

One type of rotatable mount for trophies is disclosed in U.S. Pat. No. 2,843,959 issued to Flauder. The Flauder construction comprises a supported object, a dome shaped base rigid therewith, a bottom closure plate for the base and a hollow mounting block rotatably supporting the base bottom plate, a closure plate on the lower end of the mounting block, and a pedestal connected to the closure disc, the base including a depending threaded stud, the bottom plate including an internally threaded sleeve in which the stud is engaged to fixedly connect the base and the bottom plate. A somewhat similar construction for mounting trophies and the like is disclosed in U.S. Pat. No. 2,291,975 issued to Minero.

BRIEF SUMMARY OF THE INVENTION

It is an object of the present invention to provide a novel trophy or award construction that includes a decorative member, a supporting base for supporting the decorative member and a novel spinner assembly for rotatably interconnecting the decorative member with the supporting base.

Another object of the invention is to provide a trophy or award construction of the aforementioned character that has several alternate configurations. For example, in one form of the invention a novel spinner assembly is provided for rotatably interconnecting the decorative member with the supporting base using a short riser member and in another form of the invention a novel spinner assembly is provided for rotatably interconnecting the decorative member with a much taller riser member that is disposed between the supporting base and the spinner assembly. In still another form of the invention the decorative member is connected to a tall riser member and a novel spinner assembly is provided for rotatably connecting the riser member to the supporting base.

Another object of the invention is to provide an award construction as described in the preceding paragraph in which the novel spinner assembly includes a hollow housing having a sidewall having an upper flange portion and a spinner base connected to the side wall, a threaded connector member connected to and extending from the spinner base, a cover member removably connected to the upper flange portion of the side wall and a rotating member mounted within the hollow housing for rotation with respect thereto.

Another object of the invention is to provide an award construction as described in the preceding paragraphs in which the spinner base has a central cavity and in which the rotating member has a lower protuberance received within the central cavity for rotation with respect thereto.

Another object of the invention is to provide an award construction of the character described in which the upper flange portion of the spinner assembly is provided with a plurality of circumferentially spaced apart connector segments and in which the cover member of the spinner assembly is provided with a plurality of spaced apart slots configured and arranged to receive the plurality of circumferentially spaced apart connector segments.

These and other objects of the invention will be realized from the apparatus described in the paragraphs that follow.

DETAILED DESCRIPTION OF THE INVENTION

Figure 1A:
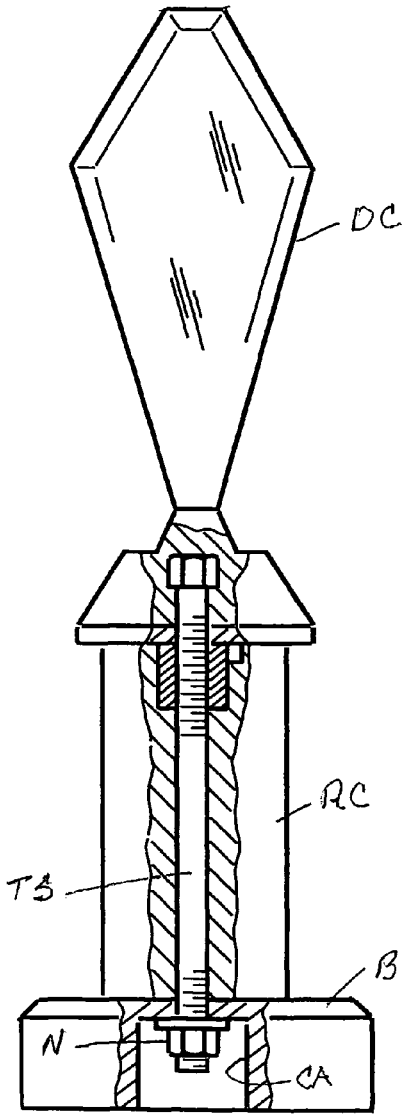
Fig. 1A Prior Art
FIG. 1A is a front view partly broken away to show internal construction of a typical prior art trophy device.

Referring to the drawings and particularly to FIG. 1A, one form of prior art award trophy apparatus is there shown. This type of prior art trophy construction comprises a decorative component "DC", a supporting base "B", and a decorative riser column "RC" that extends between the supporting base and the base of the decorative component. Molded into the base of the decorative component is the head a bolt having threaded shank "TS" that extends downwardly from the base of the decorative component in the manner shown in FIG. 1A. The lower portion of the threaded shank "TS" extends through an aperture provided in base "B" and into a cavity "CA" formed in the base. A threaded nut "N" functions to interconnect the decorative component with the base "B" in the manner shown in FIG. 1A. As is typical of most prior art award trophies, the decorative component "DC" is affixed to the riser column "RC" and does not rotate.

Figure 1:
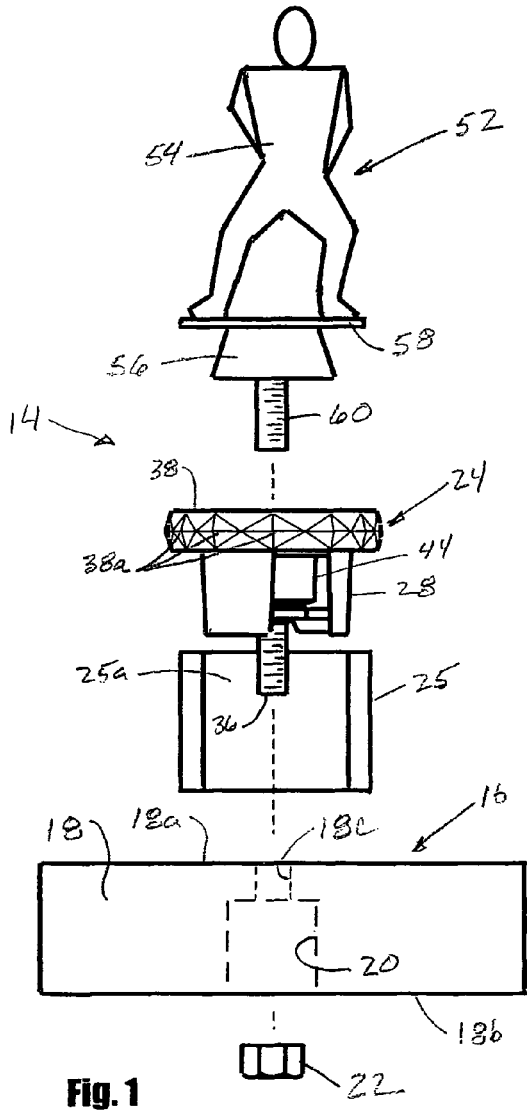
FIG. 1 is a front, exploded view of one form of the Spinner Trophy apparatus of the present invention.

Turning to FIGS. 1 and 4 through 8, one form of the spinner trophy of the present invention is there shown and generally designated in FIG. 1 by the numeral 14. Spinner trophy 14 here comprises a supporting base assembly 16 comprising a supporting base 18 having an upper surface 18*a* and a lower surface 18*b* that is provided with a cavity 20. Supporting base 18 is also provided with a central aperture 18*c*. Also forming a part of base assembly 16 is a threaded nut 22 that is receivable within cavity 20.

In a manner presently to be described, in the present form of the invention a uniquely constructed spinner assembly 24 is connected to a relatively short riser member 25 that rests on the upper surface 18*a* of the supporting base 18. Spinner assembly 24 here comprises a hollow housing 26 (FIGS. 5, 6 and 7) that includes a sidewall 28 having an upper flange portion 30 and a spinner base 32 connected to and spanning the side wall. Sidewall 28 and spinner base 32 cooperate to define an internal chamber 33. As best seen in FIG. 6 of the drawings, sidewall 28 is provided with a plurality of circumferentially spaced, enlarged diameter wall segments 29 and upper flange portion 30 is provided with a plurality of circumferentially spaced apart bayonet like connector segments 30*a*.

Figure 7:
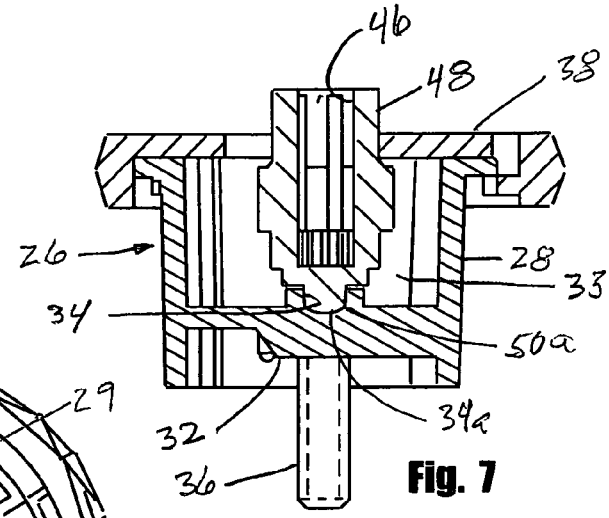
FIG. 7 is a cross-sectional view taken along lines 7-7 of FIG. 4.
Figure 8:
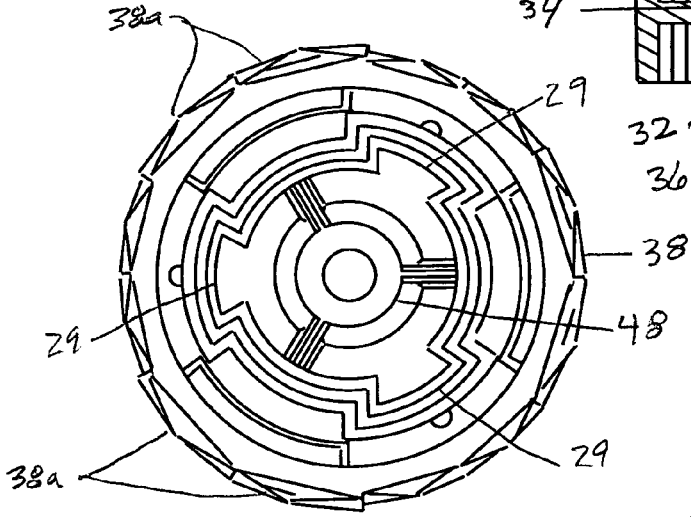
FIG. 8 is a view taken along lines 8-8 of FIG. 5.

As illustrated in FIG. 7, spinner base 32 is provided with a uniquely configured, centrally disposed, generally cup shaped cavity 34. Cup shaped cavity 34, which forms an important aspect of the apparatus of the present invention, has a smooth, curved bottom wall 34*a*. Connected to and extending from spinner base 32 is a threaded connector member 36.

Figure 4:
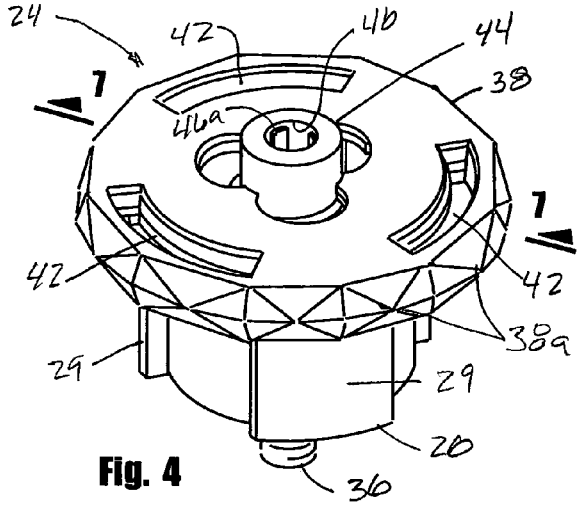
FIG. 4 is a generally perspective top view of the Spinner Lid assembly of the invention.
Figure 5:
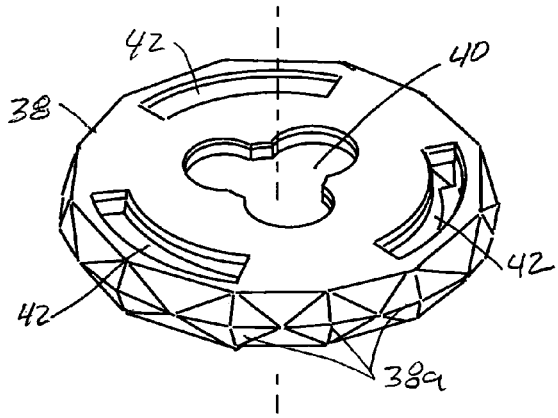
FIG. 5 is a generally perspective bottom view of the Spinner Lid assembly.
Figure 5:
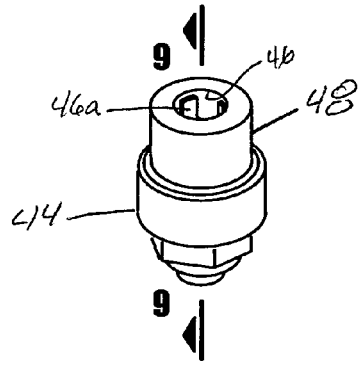
Figure 5:
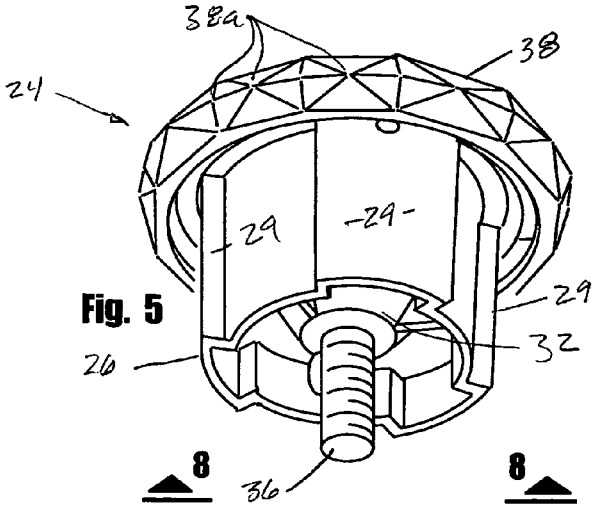
Figure 6:
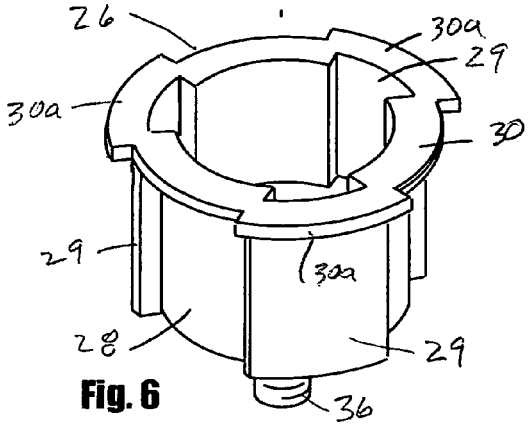
FIG. 6 is a generally perspective exploded view of the Spinner Lid assembly.

A uniquely configured cover member 38 is removably connected to the upper flange portion 30 of side wall 28 of hollow housing 26 in the manner illustrated in FIGS. 4, 5, 7 and 8 of the drawings. Cover member 38 is provided with a generally three leaf clover shaped central opening 40 and a plurality of circumferentially spaced, generally arcuate shaped openings 42 that are constructed and arranged to receive the circumferentially spaced apart bayonet like connector segments 30*a* formed on flange portion 30 (see FIG. 7). As illustrated in FIGS. 4, 5 and 6, cover member 38 includes a circumferentially extending edge portion that is provided with a plurality of diamond shaped protuberances 38*a*.

Figure 9:
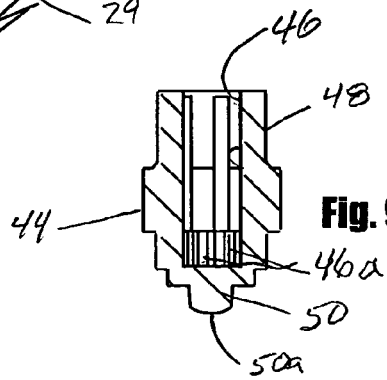
FIG. 9 is a cross-sectional view taken along lines 9-9 of FIG. 6.

Forming an important feature of the spinner trophy apparatus of the present invention is a uniquely configured rotating member 44 that is mounted within hollow housing 26 for rotation with respect thereto. As best seen in FIGS. 7 and 9 of the drawings, rotating member 44 is provided with a central bore 46 and includes an upper neck portion 48 that extends through central opening 40 of the cover member when the spinner assembly is assembled in the manner shown in FIGS. 4 and 7 of the drawings. Rotating member 44 is also provided with a lower protuberance 50 that is received within the central cup shaped cavity 34 of the spinner base for rotation with respect thereto. Uniquely, lower protuberance 50 terminates in a bearing surface 50*a* that rotatably engages the smooth, curved bottom wall 34*a* of the cup shaped cavity 34 (see FIG. 7).

With the construction described in the preceding paragraphs, the rotating member 44 can be positioned within the internal chamber 33 of hollow housing 26 in a manner such that the bearing surface 50*a* of the lower protuberance 50 of the rotating member is seated within cavity 34*a*. This done, cover member 38 can be positioned over the flange portion 30 of the hollow housing 26 and rotated relative to the bayonet like segments 30*a* so as to securely interconnect the cover member with the hollow housing and to strategically position the rotating member within hollow housing 26.

Turning once again to FIG. 1, it can be seen that riser member 25 is disposed between the spinner assembly 24 and the supporting base 18 and has a central space 25*a*. As depicted in the drawings, in this form of the invention a portion of the hollow housing 26 of the spinner assembly is telescopically receivable within the central space 25*a* of the riser member so that the lower portion of the threaded member 36 extends into the cavity 20 formed in the base 18. With this construction, the nut 22 can be readily interconnected with threaded member 36 so as to securely interconnect the spinner assembly and the riser member with the base 18.

In a manner next to be described, a decorative member assembly 52 is connected to the spinner assembly 24. In the present form of the invention decorative member assembly 52 includes a decorative member 54, a decorative member base 56, a decorative member platform 58 that is disposed between the decorative member and the decorative member base, and a threaded connector 60 that is connected to the decorative member base 56. Uniquely, threaded connector 60 is self threading and is threadably receivable within the central bore 46 of rotating member 44. As indicated in FIG. 9, the central bore 46 of the rotating member is provided with a plurality of radially inwardly extending ribs 46*a* that tend to grip the self threading threaded connector 60 so as to securely interconnect the decorative member assembly 52 with the spinner assembly 24.

Figure 2:
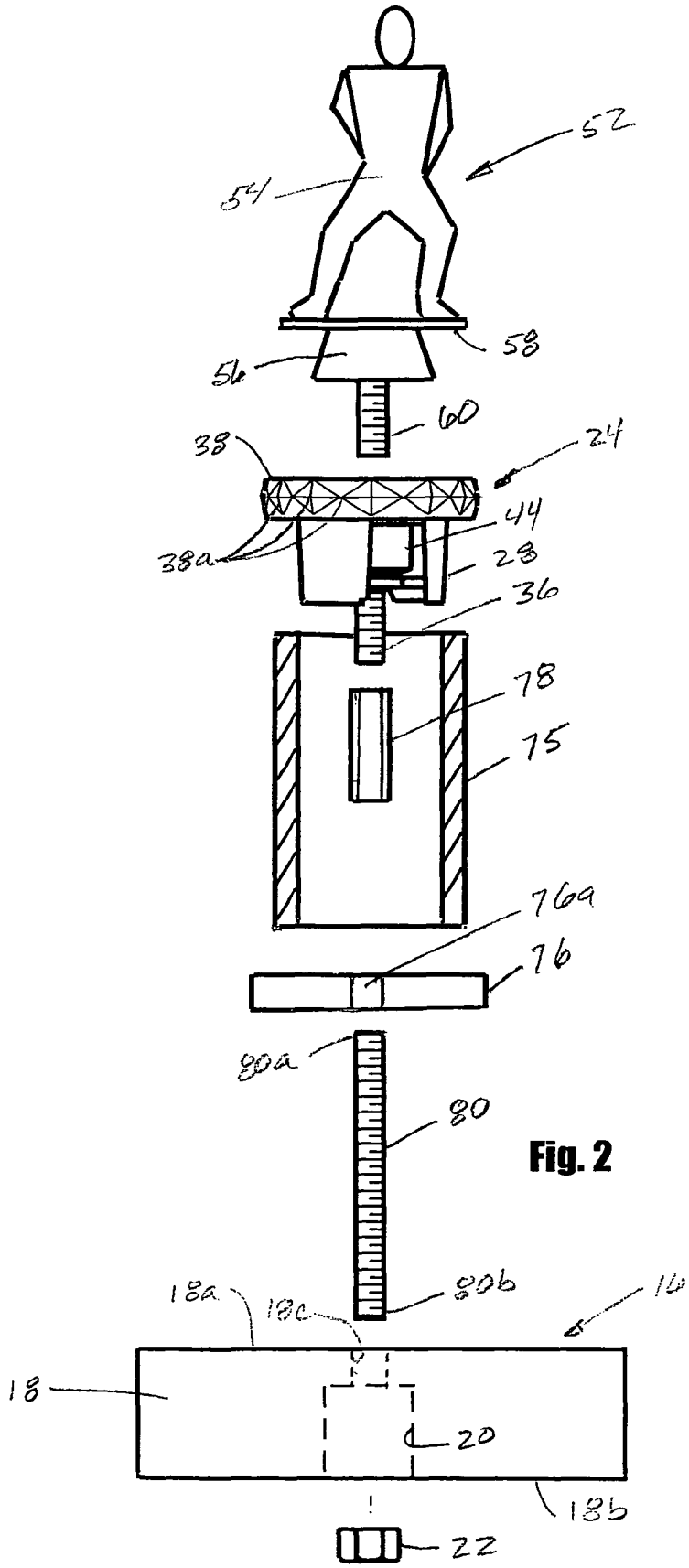
FIG. 2 is a front, exploded view of an alternate form of the Spinner Trophy apparatus of the invention.

Referring next to FIG. 2, an alternate form of the spinner trophy of the invention is there shown and generally designated by the numeral 74. Spinner trophy 74 is similar in many respects to the spinner trophy illustrated in FIGS. 1 and 4 through 9 of the drawings and the like numbers are used in FIG. 2 to identify like components.

As before, spinner trophy 74 comprises a supporting base assembly 16 and a uniquely constructed spinner assembly 24 both of which are substantially identical in construction and operation to those previously described. However, in this latest form of the invention, spinner assembly 24 is connected to a much longer, generally tubular shaped riser member 75 that rests on a base plate 76. Base plate 76, which is provided with a central aperture 76*a*, rests on the upper surface of the supporting base 18.

As before, an important feature of the spinner trophy apparatus of this latest form of the invention is a uniquely configured rotating member 44 that is provided with a downwardly extending threaded connector member 36. As indicated in FIG. 2 of the drawings, in this latest embodiment of the invention, the spinner trophy further includes an internally threaded, generally tubular shaped coupler member 78 that is disposed within riser member 75 and is threadably connected to the threaded connector member 36 of the spinner assembly. An elongated, externally threaded connector rod 80 having a first end 80*a* and a second end 80*b* is also disposed within riser member 75. Connector rod 80 extends through the aperture 76*a* formed in plate 76 and the first end 80*a* thereof is threadably connected to coupler member 78. The connector rod 80 also extends through the central aperture 18*c* of base 18 and into cavity 20 wherein nut 22 is interconnected with the second end 80*b* of the connector rod.

As in the earlier described embodiment of the invention, a decorative member assembly 52 which is of substantially identical construction to that previously described, is connected to the spinner assembly 24 in the same manner as previously described.

Figure 3:
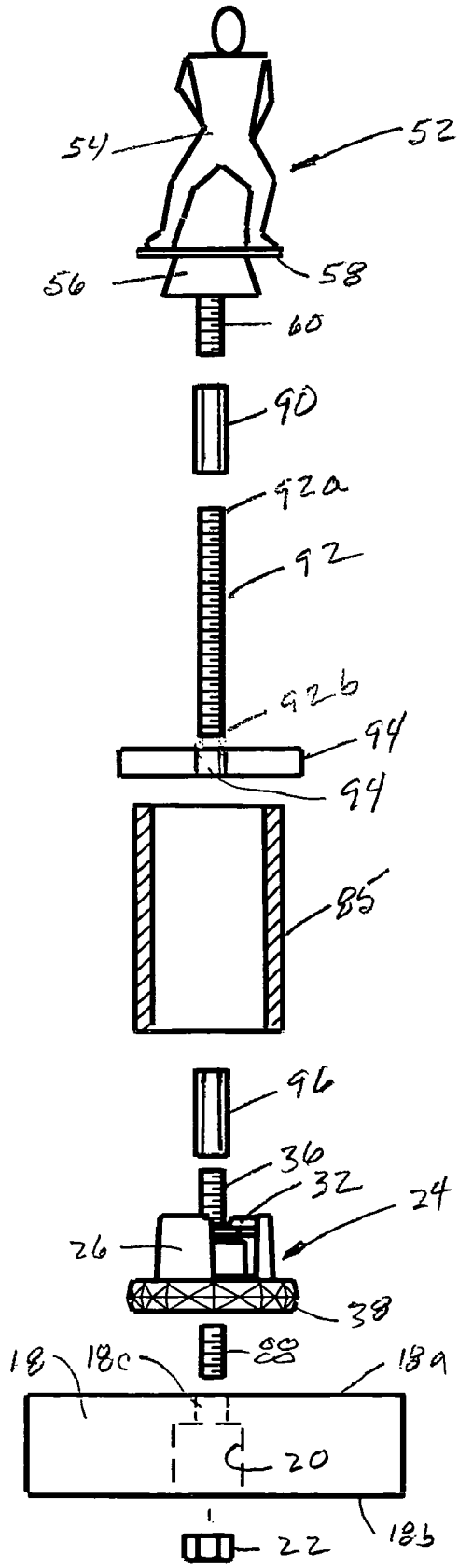
FIG. 3 is a front, exploded view of still another form of the Spinner Trophy apparatus of the invention.

Referring next to FIG. 3, still another form of the spinner trophy of the invention is there shown and generally designated by the numeral 84. Spinner trophy 84 is also similar in many respects to the spinner trophy illustrated in FIGS. 1 and 4 through 9 of the drawings and like numbers are used in FIG. 2 to identify like components.

As before, spinner trophy 84 comprises a supporting base assembly 16 and a uniquely constructed spinner assembly 24, both of which are substantially identical in construction and operation to those previously described. However, in this latest form of the invention, spinner assembly 24 is inverted, is connected directly to base 18 and functions to rotatably support a generally tubular shaped riser member 85 having a first end 85*a* and a second end 85*b*. Spinner assembly 24 is connected to base 18 by an externally threaded connector rod 88, one end of which is connected to threaded nut 22 and the other end of which is threadably received within bore 46 of rotating member 44.

The spinner trophy of this latest form of the invention also includes a first coupler member 90 that is connected to the threaded connector member 60 of the decorative member assembly 52. Connected to first coupler member 90 is a first threaded rod 92 that is disposed within riser member 85. First rod 92 has a first end 92*a* that is connected to the first coupler member and a second end 92*b*. First rod 92 extends through the central aperture 94*a* of a top plate 94 and into riser 85. A second internally threaded coupler member 96 is connected to the second end 92*b* of threaded rod 92 and is also connected to the threaded connector member 36 that extends from the spinner base 32 of the hollow housing 26 of the spinner assembly 24. With the construction thus described, when the second threaded rod 88 is connected to nut 22 and to the spinner assembly 24, the spinner assembly, the riser 85, a top plate 94 and the decorative member assembly 52 are all interconnected with the base 18.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. A spinner trophy comprising:

(a) a supporting base having an upper surface and a lower surface;

(b) a bottom plate disposed in engagement with said upper surface of said supporting base, said bottom plate having a central aperture;

(c) a riser member disposed engagement with said bottom plate;

(d) a spinner assembly connected to said riser member and including:

(i) a hollow housing having a sidewall having an upper flange portion and a spinner base connected to said side wall, said spinner base having a centrally disposed cavity;

(ii) a threaded connector member connected to and extending from said spinner base;

(iii) a cover member removably connected to said upper flange portion of said side wall of said hollow housing, said cover member having a central opening; and (iv) a rotating member mounted within said hollow housing for rotation with respect thereto, said rotating member having a central bore and including:

a) an upper neck portion extending through said central opening of said cover member; and b) a lower protuberance received within said central cavity of said spinner base for rotation with respect thereto; and (e) a decorative member assembly connected to said spinner assembly, said decorative member assembly including:

(i) a decorative member;

(ii) a decorative member base; and (iii) a threaded connector connected to said decorative member base, said threaded connector being threadably receivable within said central bore of said rotating member.

2. The spinner trophy as defined in claim 1 in which a portion of said hollow housing of said spinner assembly is telescopically receivable within said riser member.

3. The spinner trophy as defined in claim 1 in which said lower surface of said supporting base is provided with a central cavity and in which said base further includes a threaded nut for threadable interconnection with said threaded connector member of said spinner assembly for interconnecting said spinner assembly with said supporting base.

4. The spinner trophy as defined in claim 1 in which said surface of said supporting base is provided with a central cavity and in which said spinner trophy further comprises:

(a) a coupler member connected to said threaded connector member of said spinner assembly;

(b) an elongated threaded rod disposed within said riser member and connected to said coupler member; and (c) a threaded nut threadably connected to said threaded rod for interconnecting said spinner assembly with said supporting base.

5. The spinner trophy as defined in claim 1 in which said supporting base is provided with a central cavity and in which said spinner trophy further comprises:

(a) a first coupler member connected to said threaded connector member of said decorative member assembly;

(b) an first threaded rod disposed within said riser member, said first rod having first and second ends, said first end being connected to said first coupler member;

(c) a second coupler member connected to said second end of said elongated threaded rod and also connected to said threaded connector member that is connected to and extends from said spinner base;

(d) a second threaded rod having first and second ends, said first end being threadably received within said central bore of said rotating member; and (e) a threaded nut received within said central cavity of said supporting base, said threaded nut being threadably interconnected with said second end of said second threaded rod for interconnecting said spinner assembly with said supporting base.

6. A spinner trophy comprising:

(a) a supporting base;

(b) a spinner assembly connected to said supporting base, said spinner assembly including:

(i) a hollow housing including a spinner base having a centrally disposed cavity;

(ii) a threaded connector member connected to and extending from said spinner base;

(iii) a cover member connected to said hollow housing, said cover member having a central opening; and (iv) a rotating member mounted within said hollow housing for rotation with respect thereto, said rotating member having a central bore and including:

a) an upper neck portion extending through said central opening of said cover member; and b) a lower protuberance received within said central cavity of said spinner base for rotation there within;

(c) a decorative member assembly connected to said rotating member of said spinner assembly for rotation therewith; and (e) a riser member disposed between said spinner assembly and said supporting base, a portion of said hollow housing of said spinner assembly being telescopically receivable within said riser member.

* * * * *